United States Patent [19]

Potter et al.

[11] Patent Number: 4,715,517

[45] Date of Patent: Dec. 29, 1987

[54] DISPENSER HAVING A ROLLER FOR SQUEEZING MATERIAL FROM A TUBE

[75] Inventors: Charles Potter, Stow; Ronald F. Bell, Uniontown; John M. Tosill, Barberton, all of Ohio

[73] Assignee: Go-Jo Industries, Inc., Cuyahoga Falls, Ohio

[21] Appl. No.: 878,643

[22] Filed: Jun. 26, 1986

[51] Int. Cl.[4] ..... B65D 35/28

[52] U.S. Cl. ..... 222/181; 222/183; 222/212; 222/214; 251/7

[58] Field of Search ..... 222/96, 101-103, 222/105, 181, 183, 185, 207, 209, 212, 214, 325, 444-447; 251/7

[56] References Cited

U.S. PATENT DOCUMENTS

| | | | |
|---|---|---|---|
| 1,352,425 | 9/1920 | Boye | 222/101 |
| 2,052,364 | 8/1936 | Southey | 222/101 |
| 2,113,022 | 4/1938 | Hefti | 222/214 X |
| 2,476,346 | 7/1949 | Acosta | 222/96 |
| 2,528,662 | 11/1950 | Miller | 222/101 |
| 2,755,974 | 7/1956 | Godfrey | 222/494 |
| 2,936,006 | 5/1960 | Henley | 222/101 |
| 2,964,218 | 12/1960 | Shermer | 222/101 |
| 2,993,626 | 7/1961 | Gildersleeve | 222/214 |
| 3,066,832 | 12/1962 | Rossetti | 222/214 X |
| 3,368,722 | 2/1968 | Wallace | 222/214 |
| 3,741,439 | 6/1973 | Vehrs | 222/103 |
| 3,768,704 | 10/1973 | Beguin | 222/207 |
| 3,881,641 | 5/1975 | Plimi, Jr. et al. | 222/207 |
| 4,178,975 | 12/1979 | Crespi | 222/105 X |
| 4,256,242 | 3/1981 | Christine | 222/207 |
| 4,349,133 | 9/1982 | Christine | 222/183 |
| 4,350,268 | 9/1982 | Potter | 222/214 |
| 4,448,329 | 5/1984 | Vilaseca et al. | 222/96 |
| 4,546,904 | 10/1985 | Frassanito | 222/185 |
| 4,573,612 | 3/1986 | Maddison et al. | 222/94 |
| 4,621,749 | 11/1986 | Kanfer | 222/183 X |
| 4,667,854 | 5/1987 | McDermott et al. | 222/101 |

FOREIGN PATENT DOCUMENTS

| | | | |
|---|---|---|---|
| 1094277 | 5/1955 | France | 222/96 |
| 513665 | 2/1955 | Italy | 222/96 |

*Primary Examiner*—Joseph J. Rolla
*Assistant Examiner*—Kevin P. Shaver
*Attorney, Agent, or Firm*—Reese Taylor

[57] ABSTRACT

A fluid dispenser for use with a source of fluid having a flexible, valveless dispensing tube includes a base unit for support of the fluid source and a closure member normally closing off the end of the tube. The dispenser carries a cam and spring assembly which, upon the application of the hand pressure, moves a roller into engagement with the tube and moves the closure member out of engagement with the tube to open the end thereof and permit the fluid to be ejected therefrom.

8 Claims, 9 Drawing Figures

DISPENSER HAVING A ROLLER FOR SQUEEZING MATERIAL FROM A TUBE

BACKGROUND OF THE INVENTION

This invention relates, in general, to apparatus for dispensing fluid and relates in particular to an apparatus for dispensing fluids from a replaceable container having a flexible dispensing tube, either secured thereto or integral therewith.

DESCRIPTION OF THE PRIOR ART

There are a number of prior art devices for dispensing liquids, paste or pastes containing solids and particularly various types of cleaning materials, such as soap or hand cleaner from replaceable cartridges. In most of this art the dispensing apparatus per se is intended to be more or less permanently mounted at the point of use and then to be refillable with a replaceable cartridge, bag or other container.

In general terms, the prior art also discloses that the replaceable container often takes the form of a bag with an elongate flexible tube secured thereto and with the material being dispensed by collapsing the tube and expelling the fluid from the end of the tube with the tube being refilled behind or above the collapsing means.

Examples of prior art of this general nature can be seen in Christine U.S. Pat. No. 4,256,242, Pliml U.S. Pat. No. 3,881,641, Vehrs U.S. Pat. No. 3,741,439, Potter U.S. Pat. No. 4,350,268.

While these dispensers are presumably effective for their designed purpose, they do have some inherent drawbacks. First, they generally include an internal valve which presents an added expense itself and also added assembly expense in that the valve must be placed in the tube at some time during assembly. Second, these valves present some additional disadvantages depending upon the type of material being dispensed in that, when any type of solid material such as grit, pumice, etc. is compounded into the material being dispensed for enhanced cleaning action there is a definite tendency for the valving to clog.

Since many of the dipensers of this general type are intended to be used with soaps or hand cleaners and since it is often desirable to include such particulate material these valving problems can present serious difficulties.

Other collapsible tube-type dispensers of various designs can be seen in a number of other U.S. patents such as Boye U.S. Pat. No. 1,352,425, Southey U.S. Pat. No. 2,052,364, Acosta U.S. Pat. No. 2,476,346, Miller U.S. Pat. No. 2,528,662, Godfrey U.S. Pat. No. 2,755,974, Henley U.S. Pat. No. 2,936,006, Shermer U.S. Pat. No. 2,964,218, Gildersleeve U.S. Pat. No. 2,993,626, Wallace U.S. Pat. No. 3,368,722 and Beguin U.S. Pat. No. 3,768,704.

In any event, while the general concept of collapsing tubes to expel the contents from an open end thereof are generally well known in the art noted above, certain difficulties and disadvantages are encountered in actual use and fabrication of such devices as also just noted.

SUMMARY OF THE INVENTION

It has been found that the above-noted disadvantages and difficulties can be overcome by providing a dispensing apparatus which is capable of dispensing material from a container having a collapsible, flexible dispensing tube, but devoid of any internal valving whatsoever.

It is, therefore, an object of this invention to provide an apparatus for dispensing material from a valveless tube while securing the tube against leaking or dripping in the non-dispensing mode.

It is a further object of the invention to provide such a dispenser which permits dispensing of fluids of widely differing viscosities with equal ease and in addition, the dispensing of fluids containing particulate matter.

It is a further object of the invention to provide such a dispensing apparatus wherein peristalic action is achieved by a roller as the material is dispensed, so as to create a vacuum behind the tube to pull in new fluid from the container, thereby emptying the tube ahead of the roller and filling it behind the roller simultaneously so as to expedite re-use.

It is a further object of the invention to provide a dispensing apparatus enabling the dispensing or distal end of the tube to be immediately closed at the end of the dispensing stroke, so as to prevent the entrance of air bubbles into the end of the tube, while securely closing the tube against leakage or dripping.

Accordingly, production of an improved fluid dispensing apparatus of the type just described becomes the principal object of this invention with other objects thereof becoming more apparent upon the reading of the following brief specification considered and interpreted in view of the accompanying drawings.

OF THE DRAWINGS

DESCRIPTION OF THE PREFERRED EMBODIMENT

Figure 1:
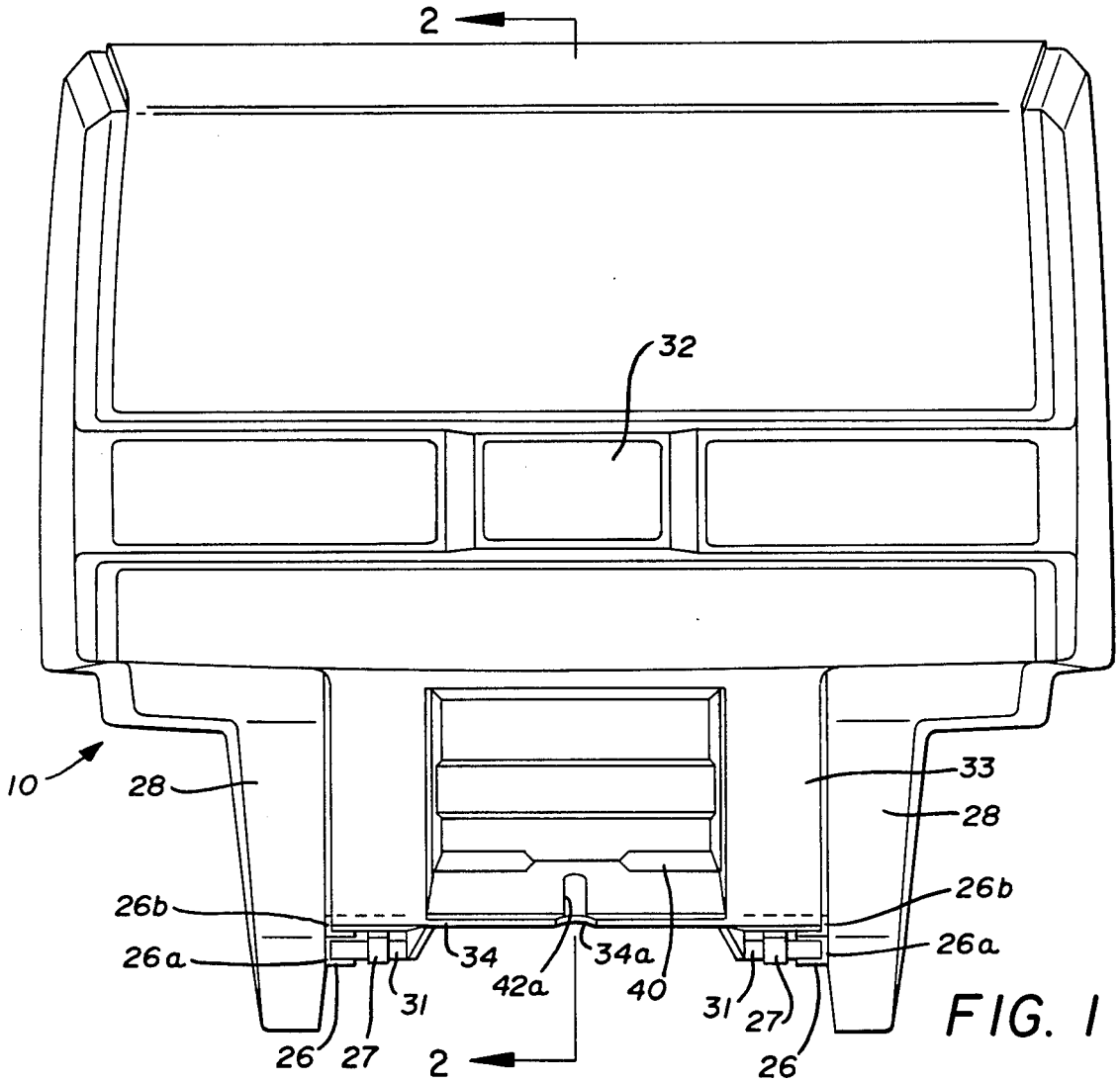
FIG. 1 is a front elevational view of the improved dispenser.

Referring first to FIG. 1 of the drawings, it will be noted that the improved dispenser assembly, generally indicated by the numeral 10, includes two main components, namely a base unit 20 and a cover unit 30 in addition to the container C which carries the material to be dispensed.

Figure 2:
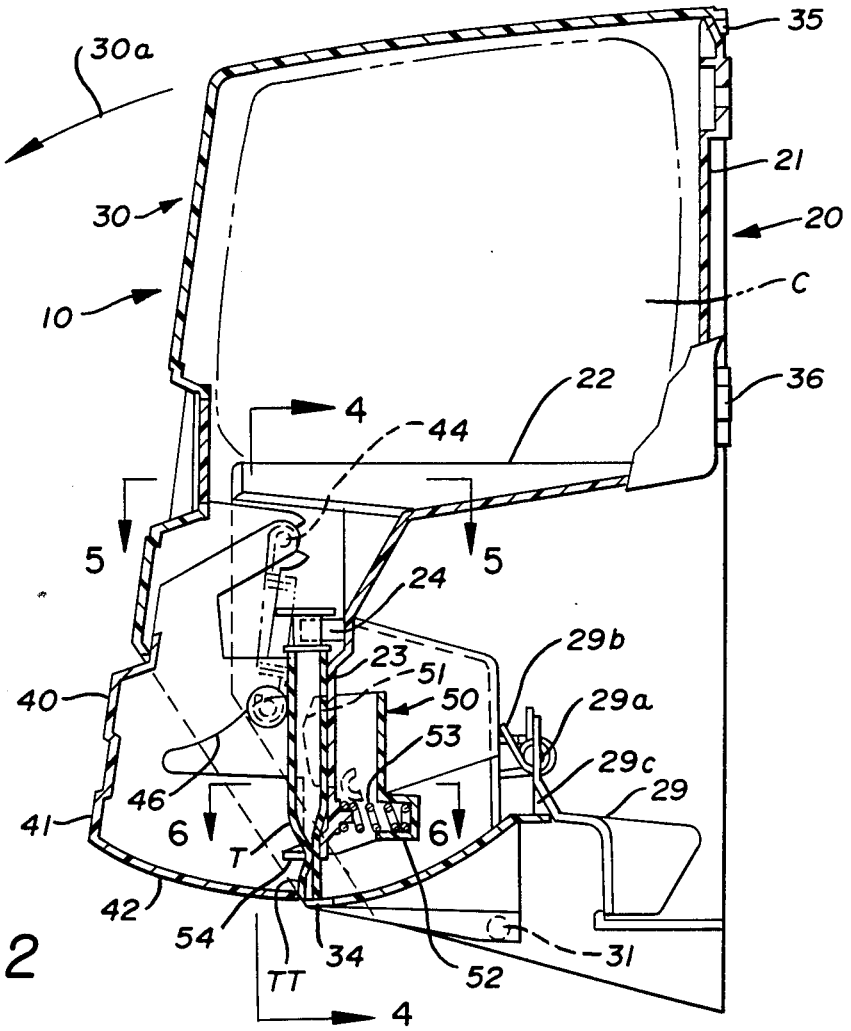
FIG. 2 is a sectional view taken along the line 2—2 of FIG. 1 and showing the dispensing apparatus in the non-dispensing position.

Referring to FIGS. 1 and 2, the base unit 20 includes a planar wall mounting panel 21 suitable for mounting on a wall or other vertical surface. The means of attachment of panel 21 to such surface are not illustrated in detail since it is believed well within the scope of one of ordinary skill in this art to devise suitable screws, clips or adhesive mounting means for dispensers of this general nature.

The base unit 20 also includes a cartridge support panel 22 which projects generally normally from panel 21 and on which the cartridge containing the soap or other fluid and generally indicated by the letter C can be supported with the tube T depending therefrom.

It should be noted that the term "cartridge" is employed throughout for brevity of description but any suitable container can be employed. That is, the container must be fluid impermeable and have a flexible dispensing tube with an uninterrupted internal bore connected thereto.

Still referring to FIGS. 1 and 2, it will be seen that base unit 20 also includes a substantially vertically depending tube support element 23 against which the tube T is received between the top locating members 24,24 and the bottom locating members 25,25 (See FIG. 4) which project outwardly from element 23 and serve to engage and position the tube.

The cover unit 30 is hinged at its bottom to the base unit 20 by the hinge pins 31,31 which are received within brackets 26,26 on the base unit 20 and releasably engaged by clips 27,27. The brackets 26,26 have upper and lower grooves **26*a*, 26*b* which receive pins 31,31 and the clips 27,27 have complemental grooves. In the closed and locked position, the pins will be seated in the lower grooves 26*a*,26*a***.

In this fashion, the base 30 can be swung open in the direction of the arrow **30*a* so that a spent cartridge C can be removed from cartridge support panel 22** and a fresh one can be put in place when necessary.

Also, the front face of the cover 30 optionally has a window 32 through which the cartridge C can be observed so that the soap level can be monitored in the event the cartridge is transparent. In that way, if the soap or other fluid becomes low in the dispenser, suitable preparation for replacement can be made.

Figure 4:
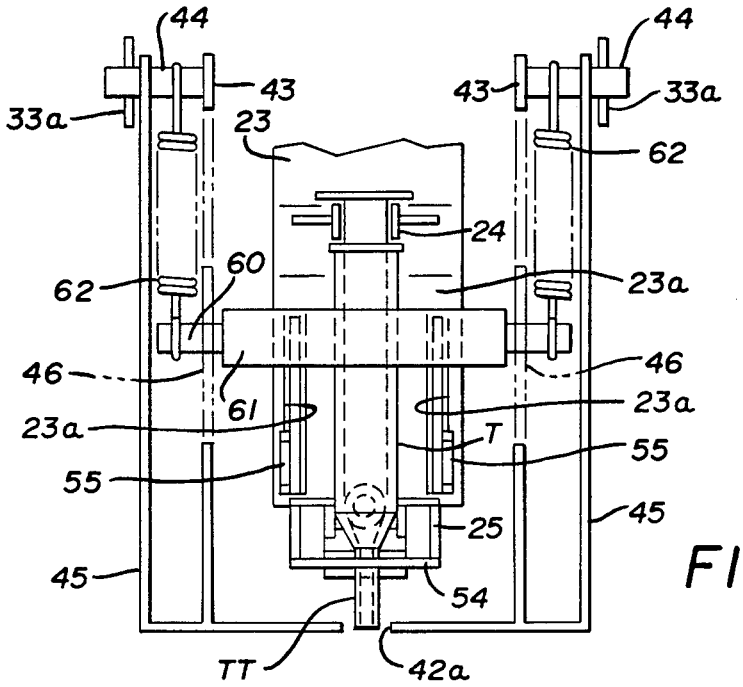
FIG. 4 is a sectional view taken along the line 4—4 of FIG. 2.
Figure 3:
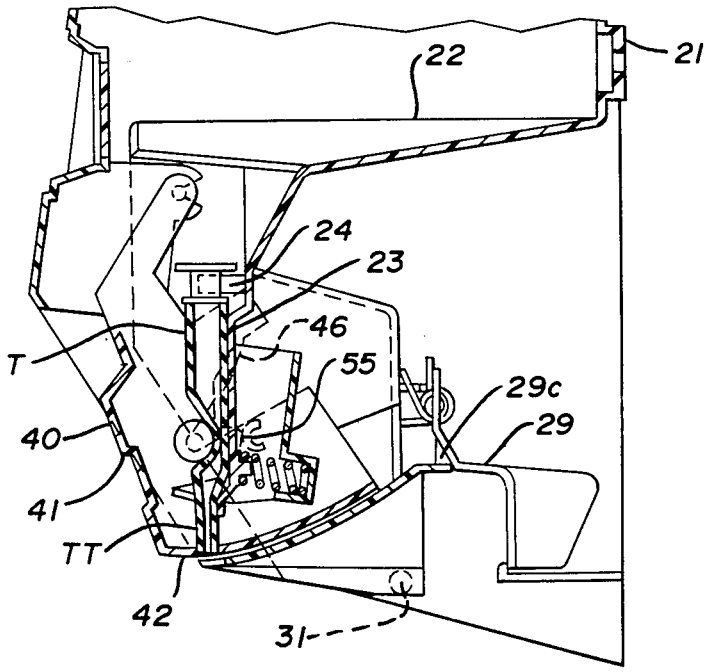
FIG. 3 is a partial sectional view similar to FIG. 2 showing the dispensing apparatus in the dispensing position.
Figure 5:
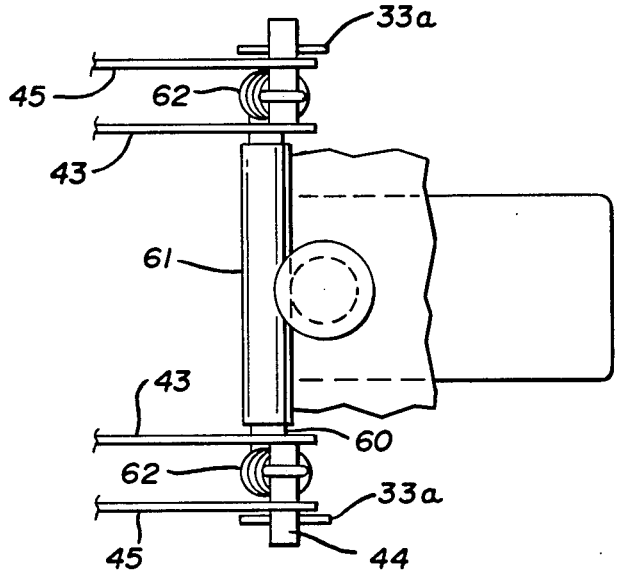
FIG. 5 is a sectional view taken along the line 5—5 of FIG. 2.
Figure 6:
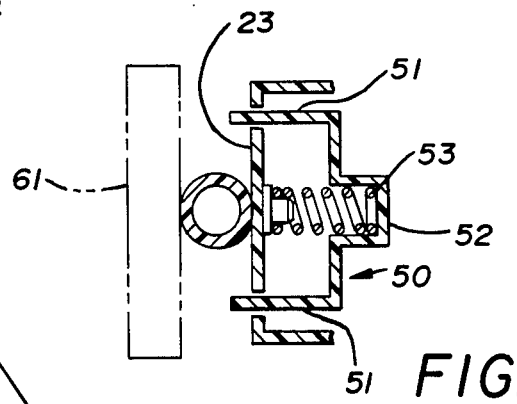
FIG. 6 is a sectional view taken along the line 6—6 of FIG. 2.

Referring next to FIGS. 2, 3 and 4, it will be noted that the cover unit 30 also includes a reduced width roller support portion 33 having opposed sidewalls and an arcuate or curved bottom panel 34. This bottom panel has a tube receiving notch **34*a*** in its forward edge for receipt of the distal end TT of the flexible tube T as will be described.

Also received and molded into the top edge of the cover 30, is at least one latch 35 which snaps over and engages the top of the rear face of the wall mounting panel 21 of the base unit 20 to secure the cover in the closed position, as can be seen in FIG. 2. The opposed side edges of cover 30 also include one or more latches 36 for similar engagement with the sides of base unit 20.

Cover unit 30 also includes a push bar assembly 40 which is mounted to the walls **33*a*,33*a* of the roller support portion 33 of the cover unit 30 for pivoting movement about the axles 44,44. The front face 41 of push bar assembly 40 is intended to be contacted by the hand of the user and terminates in and is joined to an arcuate or curved bottom panel 42. This bottom panel 42 has a curvature corresponding to that of bottom panel 34 of roller support portion 33 so that it may slide relatively thereof when pivoted about axles 44,44. Bottom panel 42 also has an elongate slot in it, designated by the numeral 42*a*, which is in alignment with notch 34*a* of bottom panel 34** for purposes of clearing the tip TT of the tube T during movement, as will be described.

As can be further seen in FIG. 4, the push bar assembly 40 includes, on each side, inner and outer sidewalls 43 and 45. The outer sidewalls 45,45 of the push bar assembly 40 carry the axles or pivot pins 44,44 for the push bar assembly which engage the sidewalls **33*a*,33*a* of the roller support portion so that they and the push bar assembly 40 pivot relatively of cover 30**.

The push bar assembly inner sidewalls 43,43 are also secured to the axles 44,44 and are spaced a slight distance inboard from the outer sidewalls 45,45. These inner sidewalls 43,43 have arcuate roller tracks 46,46 in them for engagement with the roller assembly which will be described below.

In that regard, and referring to FIGS. 4, 5 and 7 through 9, the roller assembly includes a roller rod 60 extending between the outer sidewalls 45,45. Rotatably mounted on the roller rod 60 is a roller 61 with springs 62,62 extending between the roller bar 60 and the axles 44,44. In this fashion, the roller 61 and bar 60 are normally urged to the upper position illustrated in FIGS. 2 and 7 of the drawings and out of engagement with the tube T. It will also be noted that the rod 60 is received in the roller tracks 46,46 so that movement against the force of springs 62,62 and along the curved portion thereof, can be controlled.

Returning to the base unit 20, it will be noted that a cam and closure means 50 are carried by the tube support element 23 of that unit. The cam means 50 are pivotally mounted as at trunnions 55,55 and includes cam tracks 51,51 along the top edge surface. The top edge surfaces and the cam tracks 51,51 project through elongate slots **23*a*,23*a* in the forward face of support element 23 and on opposed sides of tube T. The bottom of the cam means 50 has a spring seat 52 projecting therefrom which receives a coil spring 53 and the lower end of the cam, as viewed in FIGS. 2 and 3, includes a guillotine member 54 which serves as the valving and closure means for the tube T. Coil spring 53 is trapped between the rear of support element 23 and spring seat 52 so as to normally urge the cam means 50 to the closed position of FIGS. 2 and 7 wherein the guillotine 54** closes off the end TT of tip T.

Finally, and referring again to FIGS. 2 and 3 of the drawings, the base unit 20 includes a hinged bottom panel 29, which is mounted between opposed sidewalls of the base unit 20 by hinge pins **29*a*,29*a* and normally urged to the forward position or to the left of FIG. 2 by the springs 29*b*,29*b***.

Figure 7:
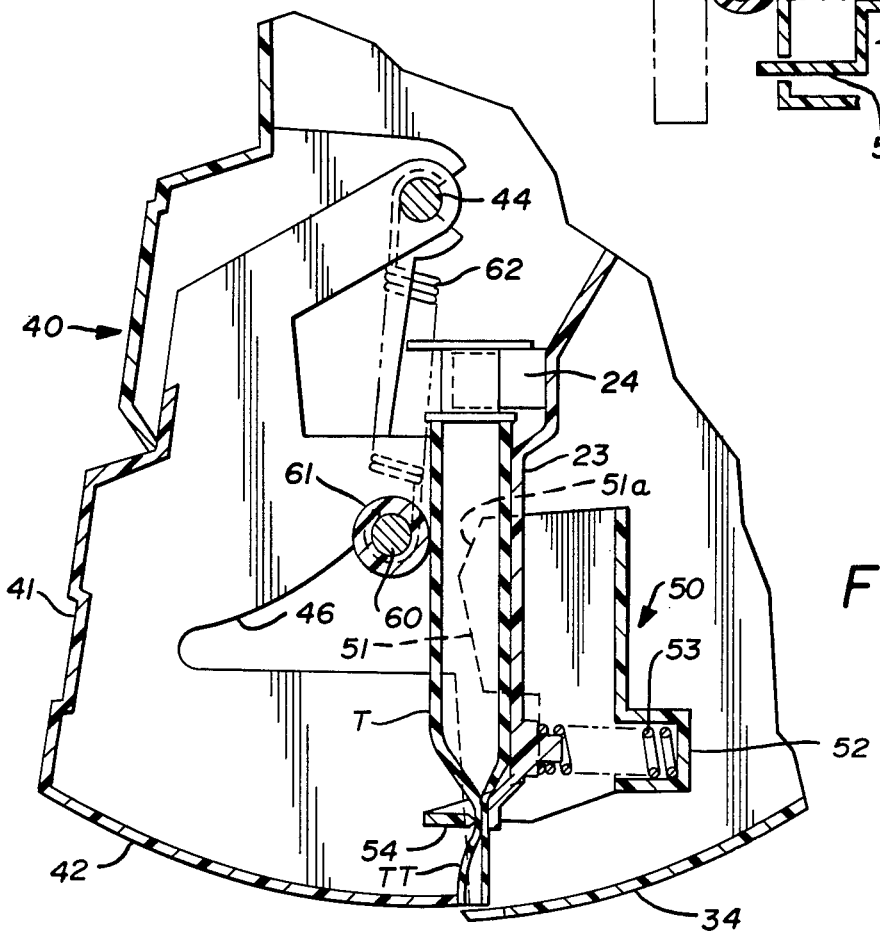
FIG. 7 is a sectional view showing the roller in the nondispensing position with the end of the tube closed.
Figure 8:
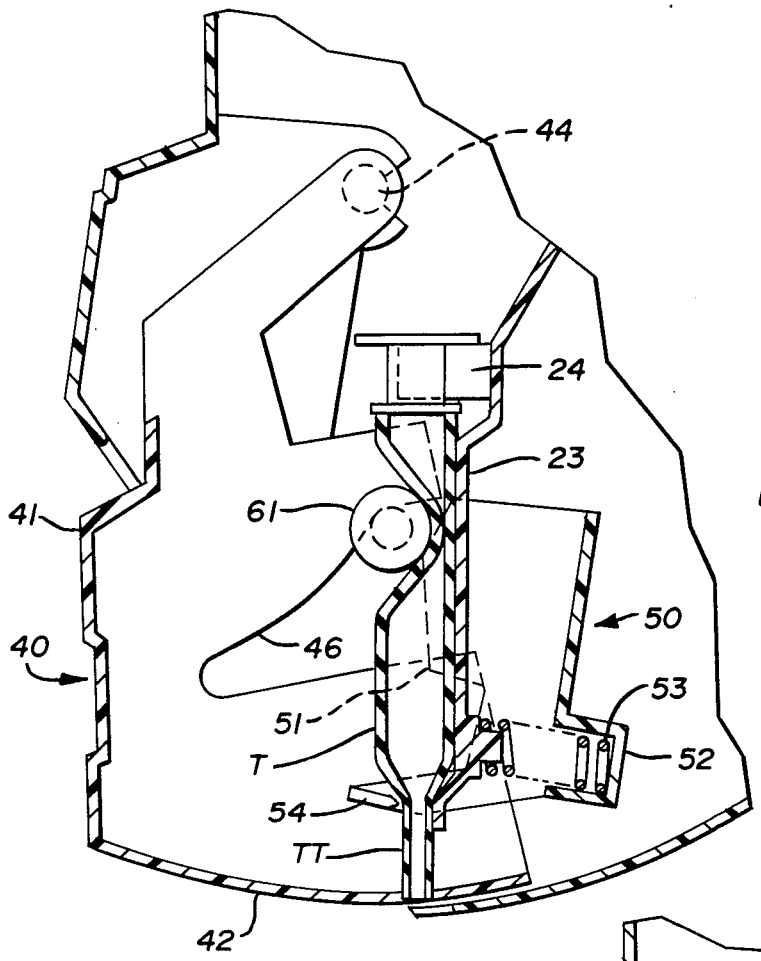
FIG. 8 is a sectional view similar to FIG. 7 showing the roller at an intermediate position during the dispensing stroke.

In use or operation of the improved dispenser, it will be assumed that the cartridge C has been loaded in place and that the tube T has been placed against the tube support element 23 between the top and bottom locating members 24,24 and 25,25 so that the distal end TT of the tube T is in the projecting position and beneath the guillotine member 54 as shown in FIGS. 2 and 7 of the drawings. It will be noted at that time, referring to FIGS. 2 and 3, that the extreme end of the tube will be received in the notch **34*a* of the cover unit 30, and also will be in alignment with the longitudinal slot 42*a* of the arcuate bottom panel 42 of the push bar assembly 40**.

It should also be noted that a press fit plug or some sort of crimping means would normally be employed to close off the end of the tube during shipment and storage and would be removed at this time.

Also at this point and referring to FIGS. 2 and 7, it will be noted that the springs 62,62 will be retaining the roller assembly, and the roller bar 60 and roller 61 thereof, in the up or "at rest" position, and that the tube T will not be compressed by the roller 61 although it may be engaged thereby. That being the case, the cam 50 will be in the position illustrated in FIGS. 2 and 7 of the drawings, due to the operation of the spring 53 against the back of the tube support element 23, and the guillotine member 54 will be in the closed position. In other words, as clearly illustrated in FIGS. 2 and 7 of the drawings, the guillotine 54 will be urged toward the forward face of the tube support element 23 and will have pinched off the tube since spring 53 will cause cam 50 to pivot about trunnions 55,55. It will be assumed at this time that the portion of the tube above the point at which it is pinched off will be full of the material to be dispensed.

When it is desired then to dispense a charge of the material, pressure will be applied, preferably by the heel of the hand of the user, against the front face 41 of the push bar assembly 40 so as to pivot the push bar assembly about axles 44,44 and move it toward the right of FIGS. 2, 7, 8 and 9 or towards the vertical wall mounting surface.

As soon as this movement starts, the roller 61 and roller bar 60 will begin to move along the curved roller tracks 46,46 and into dispensing contact with the tube T.

While the movement of push bar assembly 40 will normally be a smooth, continuous movement due to the camming action, the movement can best be understood if taken in segments.

Thus, as push bar assembly 40 is first moved, the bar 60 will move along cam tracks 51,51 overcoming the force of springs 62,62 so that roller 61 compresses tube T against support element 23. The configuration of the first portions **51*a*,51*a* of tracks 51,51 insures that this occurs, as can be seen by comparing FIGS. 7 and 8. This movement closes the tube at the upper end and, since guillotine 54** is still closing the lower end, an expulsion chamber is formed momentarily between those points.

Further pivoting of assembly 40 will, by virtue of the configuration of the remainder of cam tracks 51,51 and roller tracks 46,46 cause the bar 60 to force the cam means 50 to pivot about the points 55,55. This also will have the effect of swinging the guillotine 54 away from the tube, thereby opening the tube and permitting the material to be forced out of the end of the tube by action of the roller on the tube as it travels along the cam tracks 51,51. Effectively, at this stage, the distal end TT is open and the closure point or "pinch" point formed by roller 61 is moving toward it, as can be seen from FIG. 8.

As the roller 61 moves along the tube T toward end TT and as the bar 60 moves along the cam tracks 51,51, the guillotine 54 will be kept open by virtue again of the configuration of the cam tracks. It will be noted that during this movement, the roller is contacting only a portion of the tube at any one time, and is forcing the material ahead of it in the tube out of the end TT of the tube as it moves along. While this is happending, a vacuum is being created in the tube behind the roller 61 and which will pull new material from the cartridge C into the tube above the pinch point. This action is significant because it permits certain and rapid refilling of the tube so that as soon as the downward motion of the roller ends and the roller is returned to the starting position, the tube is ready for dispensing another charge of the fluid.

Figure 9:
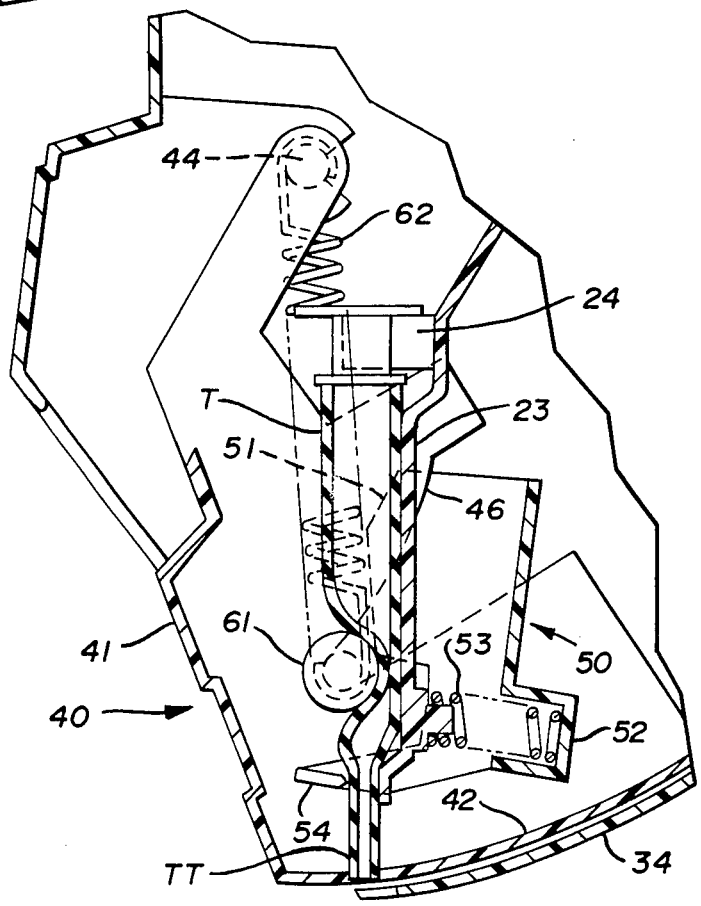
FIG. 9 is a sectional view similar to FIGS. 7 and 8 showing the roller at the end of the dispensing stroke just prior to its return to the position of FIG. 7.

Just before the push bar assembly 40 is pushed all the way to the right, it will be in the position illustrated in FIGS. 3 and 9 of the drawings. Moving the push bar assembly 40 through this range of motion will dispense the desired predetermined and measured charge of the material. Of course, at any time during that motion, the pressure could be released on the push bar and the assembly would return to the position of FIG. 2.

The final segment of movement of assembly 40 shown in FIG. 9 results in roller 61 dropping off the end of the cam tracks so that the tube is still compressed but the cam means is free to pivot back to the starting position and the guillotine 54 recloses and pinches off the tip TT of the tube T. This prevents the introduction of an air bubble into the end of the tube which could impede refilling of the tube.

It will be noted then that as soon as pressure is released from push bar 40, the springs 62,62 will pull the roller 61 and the rod 60 back to the top of the roller track 46 whereupon it is lifted off tracks 51,51 to immediately release pressure on the tube.

Therefore, as this release occurs, the pressure that the bar 60 was exerting on the cam tracks 51,51 is released and the spring 53 will pivot the cam 50 back to its original position closing the guillotine 54 as just described.

It will also be noted, as previously mentioned, that the base unit 20 has a hinged bottom panel 29. This panel is normally urged to the forward or left of FIGS. 2 and 3 and presents a closed-off appearance to the front of the overall assembly.

This panel facilitates opening of the cover. As previously noted, in the closed position, the pins 31,31 are engaged in the lowermost grooves **26*a*,26*a* of brackets 26,26 by clips 27,27. The force of springs 29*b*,29*b* will then urge lip 29*c* against the flange 34*b* of cover unit bottom panel 34. This action serves to retain the pins 31,31 in the lowermost grooves 26*a*,26*a***.

When the panel 29 is forced to the right of FIGS. 2 and 3, this engagement terminates and the pins can be moved to the upper grooves **26*b*,26*b* thereby permitting the cover to be moved vertically to enable the latches 35,36 to disengage. When the fingers encounter the bottom panel 29, they will simply push it out of the way against the force of springs 29*b*,29*b*** and when the hand is withdrawn from beneath the dispenser the panel will simply swing shut.

While a full a complete description of the invention has been set forth in accordance with the dictates of the patent statutes, it should be understood that modifications can be resorted to without departing from the spirit hereof or the scope of the appended claims.

Thus, guillotine 54 is shown being urged into collapsing contact with tube T in a "front-to-rear" motion, i.e., from left to right of FIG. 2 by operation of the push bar assembly 40. It is possible that this closing movement could also be from side-to-side, i.e., inwardly from both sides of FIG. 4 by using a vertical roller.

What is claimed is:

1. A fluid dispenser for use with a source of fluid having a flexible valveless dispensing tube having an open end, comprising:

(A) a base unit for reception of the source of fluid;

(B) external closure means for normally engaging and closing off the open end of the tube;

(C) said closure means including cam means pivotally carried by said base unit;

(D) a roller assembly engagable with said cam means and being movable into and out of collapsing and dispensing engagement with the tube;

(E) means for moving said roller assembly along said cam means and along the tube toward the open end thereof;

(F) said roller assembly cooperating with said cam means for release of said closure means during at least a portion of the time said roller assembly moves along the tube; and (G) said roller assembly disengaging said cam means and permitting return of said closure means to its normal position prior to disengagement with the tube.

2. The fluid dispenser of claim 1, wherein a cover unit is hingedly connected to said base unit; said roller assembly being operatively connected to said cover unit.

3. The fluid dispenser of claim 2, wherein said means for moving comprises a push bar assembly pivotally carried on said cover unit for movement toward said base unit.

4. The fluid dispenser of claim 3, wherein said roller assembly is carried by said push bar assembly; said push bar assembly includes a roller track; and said roller assembly is guided by said roller track into collapsing engagement with the tube upon movement of said push bar assembly toward said base unit.

5. The fluid dispenser of claim 4, wherein said roller assembly includes first tension means connected to said cover unit and normally urging said roller assembly out of collapsing engagement with the tube.

6. The fluid dispenser of claim 2, wherein said closure means includes a biasing means, said biasing means being carried by said base unit and engaging said cam means and closure means to normally urge said closure means into closing engagement with the tube.

7. The fluid dispenser of claim 6, wherein said closure means include a blade overlying the distal end of the tube and movable toward and away from said base unit.

8. A fluid dispenser for use with a source of fluid having a flexible dispensing tube, comprising:

(A) a base unit;

(B) a cover unit hingedly connected to said base unit;

(C) a tube support element carried by said base unit;

(D) cam means and closure means connected to one another and pivotally carried by said tube support element with said closure means being normally urged into closing engagement with the exterior of the tube;

(E) a push bar assembly pivotally connected to said cover unit;

(F) a roller assembly carried by said push bar assembly and movable into and out of engagement with said cam means and collapsing engagement with the tube with said roller assembly being normally urged out of contact with said cam means and collapsing engagement with the tube;

(G) said push bar assembly including a roller track for engagement with said roller assembly, (1) whereby movement of said push bar assembly about its point of pivotal connection and toward said base unit results in movement of said roller assembly along said roller track and into engagement with said cam means to release said closure means and into collapsing engagement with the tube to expel the fluid therefrom; and (H) said roller assembly being movable out of engagement with said cam means prior to movement out of collapsing engagement with the tube.

* * * * *